US010111498B1

(12) United States Patent
Johnston

(10) Patent No.: US 10,111,498 B1
(45) Date of Patent: Oct. 30, 2018

(54) TAPERED BELT BUCKLE

(71) Applicant: Trevor Jamison Johnston, Walnut Creek, CA (US)

(72) Inventor: Trevor Jamison Johnston, Walnut Creek, CA (US)

( * ) Notice: Subject to any disclaimer, the term of this patent is extended or adjusted under 35 U.S.C. 154(b) by 90 days.

(21) Appl. No.: 14/998,594

(22) Filed: Jan. 21, 2016

(51) Int. Cl.
*A44B 11/00* (2006.01)
*A44B 11/25* (2006.01)
*A44B 11/28* (2006.01)
*A45C 1/06* (2006.01)

(52) U.S. Cl.
CPC ..... *A44B 11/005* (2013.01); *A44B 11/2592* (2013.01); *A44B 11/28* (2013.01); *A45C 1/06* (2013.01); *A45C 2001/065* (2013.01)

(58) Field of Classification Search
CPC . A45C 1/06; A45C 2001/065; Y10T 24/4098; A44B 11/005; A44B 11/28; A44B 11/2592
See application file for complete search history.

(56) References Cited

U.S. PATENT DOCUMENTS 1,578,468 A * 3/1926 Rankin ..... A44B 11/005 206/101
3,088,234 A * 5/1963 Lesser ..... A44B 11/005 24/163 K
3,148,426 A * 9/1964 Lesser ..... A44B 11/005 224/163
3,927,442 A * 12/1975 Foster ..... A44B 11/005 206/37
3,969,836 A * 7/1976 DuBois ..... A44B 11/001 24/163 K
4,113,157 A * 9/1978 Woodbury ..... A44B 11/005 206/37
4,502,188 A * 3/1985 Kohli ..... A44B 11/001 24/163 K
4,753,377 A * 6/1988 Poluhowich ..... A44B 11/005 2/338
5,357,638 A * 10/1994 Mayzel ..... A44B 11/005 2/312
5,687,890 A * 11/1997 Wanner ..... A44B 11/005 224/163
7,748,088 B1 * 7/2010 Johnston ..... A44B 11/005 224/163
8,490,254 B1 * 7/2013 Johnston ..... A44B 11/005 24/163 K

* cited by examiner

*Primary Examiner* — Robert John Sandy
*Assistant Examiner* — Louis A Mercado
(74) *Attorney, Agent, or Firm* — Risto A. Rinne, Jr.

(57) ABSTRACT

An apparatus for securing a pair of trousers about a torso includes a belt buckle for attaching opposite ends of a belt thereto and a compartment. The compartment includes a pair of opposing angled vertical sidewalls for progressively curving a portion of a credit card or a driver's license or a personal identification card or a similarly sized card as the card is urged into the compartment. Friction between edges of the card, in particular where the card is curved or bowed, and a the pair of opposing angled vertical sidewalls that are in contact with the card edges secure the card in position in the compartment until a user urges the card out of the compartment. The compartment is sized to house as many cards as desired.

10 Claims, 4 Drawing Sheets

TAPERED BELT BUCKLE

This application is a related patent application Ser. No. 12/004,277 that was filed on Dec. 19, 2007 by the same inventor, and which issued as U.S. Pat. No. 7,748,088 on Jul. 6, 2010, and it is related to patent application Ser. No. 12/800,885 that was filed on May 24, 2010 by the same inventor, and which issued as U.S. Pat. No. 8,490,254 on Jul. 23, 2013.

BACKGROUND OF THE INVENTION

1. Field of the Invention

The present invention, in general, relates to belt buckles and, more particularly, to a belt buckle that includes a compartment.

Belt buckles are well known devices used far fastening a belt, such as is used to retain trousers in position.

There has been a long-standing need to carry a valid picture identification, such as a driver's license, and credit card(s) (or debit card(s), etc.) at most times when a person is away from home. The credit or debit cards are used for purchases and the picture identification is used to verify the identity of the person and also that the age of the person is above whatever minimum threshold may be applicable.

There has also been a long-standing need not to lose the picture identification or the credit card. Loss of identification or credit/debit cards can occur as a result of misplacement of a wallet or having it fall out of a pocket, as when sitting in a chair and inclining the hips rearward. Loss can also occur by theft, including theft by pickpockets.

A wallet creates a bulge in the pocket of trousers. The bulge is aesthetically unappealing. Worse yet, it provides a clear and easy signal to any nearby pickpocket of its presence. Pickpockets (those who have skill in removing [i.e., stealing] items out of pockets) find that stealing a wallet out of a pocket is a fairly easy task to accomplish.

While various wallet designs have been provided, there has remained a longstanding need to provide an effective way of carrying proper personal identification and/or credit/debit cards that provides a secure means for retaining the personal identification and credit cards and which is also unobtrusive.

Ideally, a bystander or would-be-pickpocket should not even know that the user was carrying any form of personal identification or any credit/debit cards.

If the device served another function not commonly associated with the transport of personal identification or credit/debit cards that would be better still, as the device would be perceived by the general population as something other than a carrier of one's personal identification and/or credit/debit cards. By serving a dual function, the need for a separate device to carry the personal identification and/or credit/debit cards would also be eliminated. The user of such a device would then have one fewer thing to keep track of, remember to take, not lose, and transport. Also, without the presence of a wallet in their pants the appearance of the user would be improved.

Additionally, similar needs also apply to women as they, too, must be able to present adequate personal identification when required and to use credit and/or debit cards when necessary. As a result women often opt to carry purses or handbags of all sizes and shapes which they are, at times, apt to forget and possibly leave behind. For example when dining at a restaurant, a purse or handbag placed on the floor or on an empty chair can be easily overlooked and left behind.

Also, purses and handbags are notoriously easy targets for pickpockets as well as for a class of thieves whose modus operandi includes their approach toward a woman that has been targeted, the grabbing of her purse or handbag, the application of force to remove it from her possession, and then quickly departing with the woman's purse or handbag. If a woman is carrying a purse or handbag she is subject to the actions of pickpockets or thieves.

Additionally, there are also times when a woman cannot practically attend to her purse or handbag. For example, when she is on the floor dancing at a club it may not be practical for her to be carrying of observing her purse or handbag while she is dancing.

Accordingly, the needs of women would be similarly served by a device as described above.

Belt buckles have been modified to include compartments into which an item or items, such as a picture identification and credit card may be placed. This permits the person to not have to carry a wallet, which can be left behind in a more secure location such as at home or hidden in a locked automobile.

However, these prior-art types of belt buckles, also by the inventor of the current invention, include a spring that retains the items in position. There are disadvantages associated with the use of a spring. For example, if the spring rubs against a surface of the credit card or other type of picture identification the force of the spring may immediately or over the course of time mar the card surface. If the image is obscured, the credit card or picture identification may be declined by merchants or otherwise unusable. If the card includes a magnetic strip, the strip may become damaged and unreadable if the spring rubs against the magnetic strip.

Additionally, inclusion of a spring of any type adds complexity and cost to manufacturing, thereby increasing retail prices.

Furthermore, there is the possibility that during insertion of the credit card or identification card into the belt buckle compartment that increased resistance can be experienced when the spring is first contacted by a leading edge of the card. Contact with the edge of the card during insertion potentially creates a step that must be overcome by initially displacing the spring with the thickness of the card. This, in turn, requires the user to apply considerably more force to insert the credit card or identification card into the belt buckle compartment when the spring is first encountered. This causes a substantial increase in resistance which demands that the user apply considerably more force. Eventually, the spring is urged up over the card. At that time, friction is suddenly decreased and the card may be slammed into the receptacle. This creates a less than desirable feel for the user during use.

It is desirable that insertion of the credit card into the belt buckle compartment be smooth from beginning to end. Yet, it is also desirable that the credit card or identification card or both be securely held in position.

Additionally, as more cards are inserted into a spring held compartment, the spring is further compressed. This further increases the difficulty of insertion or removal and may be more likely to cause damage to the magnetic strip by contact with the spring.

Accordingly, there is a need for a belt buckle that is able to positively retain a user's personal identification and/or credit/debit card(s).

There is a need for a belt buckle that contains one or more credit cards and/or identification cards and which is smooth to insert or withdraw the cards therefrom from beginning to end.

There is an additional need for a belt buckle that does not cause damage to a credit card or identification card during use.

There is a further need to include the teachings herein for modification and inclusion with other prior art types of belt buckles.

There is a still further need to modify the teachings herein by inclusion of any features or attributes, as may be desired, as are found in issued U.S. Pat. Nos. 7,748,088 and 8,490,254 in the current invention.

There is yet another need to modify the teachings herein by inclusion of any features or attributes, as may be desired, as are found in any prior art type of belt buckle that includes a compartment in the current invention.

There is a need to include a belt buckle with a compartment for receiving one or more credit cards and/or identification cards, therein, which does not include a spring to retain the cards in the compartment.

As various embodiments of the instant invention help provide a more elegant solution to the various problems and difficulties as mentioned herein, or which may otherwise exist or occur and are not specifically mentioned herein, and by a showing that a similar benefit is not available by mere reliance upon the teachings of relevant prior art, the instant invention attests to its novelty. Therefore, by helping to provide a more elegant solution to various needs, some of which may be long-standing in nature, the instant invention further attests that the elements thereof, in combination as claimed, cannot be obvious in light of the teachings of the prior art to a person of ordinary creativity.

Clearly, such an apparatus would be especially useful and desirable.

2. Description of Prior Art

Belt buckles are, in general, known. For example, the following patents describe various types of these devices:

U.S. Pat. No. 3,969,836 to DuBois, that issued on Jul. 20, 1976;

U.S. Pat. No. 4,113,157 to Woodbury, that issued on Sep. 12, 1978;

U.S. Pat. No. 4,502,188 to Kohli, that issued on Mar. 5, 1985;

U.S. Pat. No. 5,357,638 to Mayzel, that issued on Oct. 25, 1994;

U.S. Pat. No. 5,687,890 to Wanner, that issued on Nov. 18, 1997;

U.S. Pat. No. 7,748,088 to Johnston, that issued on Jul. 6, 2010; and

U.S. Pat. No. 8,490,254 to Johnston, that issued on Jul. 23, 2013.

While the structural arrangements of the above described devices may, at first appearance, have similarities with the present invention, they differ in material respects. These differences, which will be described in more detail hereinafter, are essential for the effective use of the invention and which admit of the advantages that are not available with the prior devices.

OBJECTS AND SUMMARY OF THE INVENTION

It is an object of the present invention to provide a belt buckle that includes a compartment attached thereto.

It is an important object of the present invention to provide a belt buckle that provides smooth insertion of a credit card or type of personal identification card into a compartment with progressively increasing resistance until the credit card or type of personal identification card is fully inserted into the belt buckle compartment.

It is also an important object of the invention to provide a belt buckle that includes a compartment which is rigid.

Another object of the invention is to provide a belt buckle that includes a compartment which is sufficiently thin.

Another continuing object of the invention is to provide a belt buckle that includes a compartment which includes, as desired, a curvature that generally conforms to a shape of a human torso at a front of the torso at belt level.

Still another object of the invention is to provide a belt buckle that does not excessively protrude outward from a user's body when it is worn.

Yet another important object of the invention is to provide a belt buckle that includes a face plate that, as desired, is either straight or curved.

Still yet another important object of the invention is to provide a belt buckle that is able to secure a belt around a torso in a conventional manner.

A first continuing object of the invention is to provide a belt buckle that includes a compartment that includes a larger width of an interior of the compartment disposed at a first end of the compartment proximate an opening into the interior of the compartment, and which includes a smaller width of the compartment disposed at an opposite distal end of the interior of the compartment, wherein the distal end is disposed maximally away from the first end, and wherein a pair of opposite sides of the compartment provide a progressive tapering in the interior of the compartment that progressively decreases a width of the interior of the compartment when progressing from the first end to the distal end.

A second continuing object of the invention is to provide a belt buckle that is able to positively retain a user's personal identification and/or credit/debit card(s) in an interior compartment.

A third continuing object of the invention is to provide a belt buckle that is able to contain one or more credit cards and/or identification cards in a compartment and wherein insertion or removal of any of the cards is smooth and absent either a sudden increase or decrease in resistance.

A fourth continuing object of the invention is to provide a belt buckle that includes a compartment for the storage of one or more credit or identification cards therein, and which does not cause damage to the credit card or identification card during insertion, removal or prolonged storage in the compartment.

A fifth continuing object of the invention is to provide a belt buckle that includes a compartment for receiving one or more credit cards and/or identification cards, therein, and wherein the belt buckle does not include a spring to retain the cards in the compartment.

A sixth continuing object of the invention is to provide a belt buckle that can retain a credit card sized object during use and which permits easy withdrawal of the object when the object is needed.

A seventh continuing object of the invention is to provide a belt buckle that includes a compartment and wherein an appearance of a front of the belt buckle is substantially unaffected by the compartment.

An eighth continuing object of the invention is to provide a belt buckle that includes a compartment and wherein the compartment is not visible when the belt buckle is worn and is viewed from the outside.

A ninth continuing object of the invention is to provide a belt buckle that includes a container or compartment for storing a credit card or a picture-identification card or both therein and which allows removal or insertion of the cards in the container while the belt buckle is disposed around a torso and secured in position by a belt without a need for unfastening the belt buckle.

A tenth continuing object of the invention is to provide a belt buckle that includes a compartment for inserting or removing a credit card or a driver's license and wherein the compartment includes an opening at a side of the belt buckle whereby the credit card or the driver's license is urged horizontally for insertion or removal from the compartment.

An eleventh continuing object of the invention is to provide a belt buckle that includes a compartment for inserting or removing a credit card or a driver's license and wherein the compartment includes an opening at a top or alternately at a bottom of the belt buckle whereby the credit card or the driver's license is urged vertically for insertion or removal from the compartment.

A twelfth continuing object of the invention is to provide a belt buckle that includes a compartment for receiving at least one credit card therein and wherein the compartment includes means for securing the credit card in the compartment that does not damage the credit card while the credit card is disposed within the compartment.

A thirteenth continuing object of the invention is to provide a belt buckle that includes a compartment for receiving at least one credit card or personal identification card therein and wherein an end of each card is progressively curved as it is inserted into the compartment to provide a curvature in an end of the card, and wherein the curvature increases an amount of friction between the end of the card and an interior of the compartment sufficient to retain the card in the compartment.

Briefly, a tapered belt buckle that is constructed in accordance with the principles of the present invention has a compartment attached to the belt buckle that includes an opening at a side or at a top of the compartment. If desired, the opening could be disposed at a bottom of the compartment. The compartment includes an outer member that is maximally disposed away from a torso of a user when the belt buckle is worn and an inner member that is disposed closest to the torso of the user. The compartment includes a vertical opposite end that is disposed maximally away from the opening and a pair of opposite angled vertical sidewalls that extend along opposite sides of the compartment from the opening to the opposite end. The opening includes a first width. The vertical opposite end includes a second width. The first width is greater than the second width. The second width is less than either a width or a length of a credit card or a personal identification card that is inserted first into the opening. The opposite angled vertical sidewalls provide a linear or desired progressive rate of tapering of the width inside the compartment whereby the width is greatest at the opening and is least at the vertical opposite end. If the opening is disposed at a side of the belt buckle, the first width at the opening is larger than a width of the credit card or the personal identification card. If the opening is disposed at the top or at the bottom of the belt buckle, the first width at the opening is larger than the length of the credit card or the personal identification card. As the card is inserted into the compartment, the progressive narrowing of the width that is caused by the progressive tapering of the width inside the compartment applies a compressive force to the leading edges of the card which, in turn, causes a first end of the credit card or the personal identification card that was first inserted into the opening to progressively bend as the card is progressively urged further into the compartment as the card is forced to accommodate the progressively narrowing width inside the compartment. Insertion of the card into the compartment is experienced by the user as a smooth progressive increase in friction occurring between the card and the compartment until the card is fully inserted into the compartment. Full insertion of the card occurs when the first end of the card makes contact with the vertical opposite end which acts as a stop that limits further insertion of the card. Each of the cards includes an elastomeric property thereto. The increasing curvature of the first end of the card that occurs in response to a narrowing in width of the compartment applies an increasing force to an interior of the compartment by the edges at the first end of the card as the card in progressively inserted into the compartment. This force increases friction between the edges of the card and the interior of the compartment. When the card is fully inserted into the compartment friction between the edges of the card and the opposite vertical sides maintains the card in position in the compartment until the card is grasped by the user and is urged out of the compartment in reverse order. A recess is optionally included to facilitate grasping of a second end of the card by the user for removal. The amount of curvature experienced by the card when the card is fully inserted in the compartment is sufficient to retain the card in the compartment and to not exceed the elastomeric limit of the materials used to form the card. Accordingly, repeated insertion of the card into or out of the compartment does not damage the card. Insertion and removal of the card from the compartment is experienced by the user as having a smooth and pleasant feel. The compartment is sized to house as many cards as desired while ensuring that the minimum number of cards will be retained in the compartment and that no damage will occur to the cards when the maximum number of cards are retained in the compartment. The compartment can be disposed on a plane in both the X and Y axis or it can include a slight curvature along the Y axis to correspond with a desired or average curvature of the torso of the user. The belt buckle can be formed of any desired material or combination of materials, including a desired polymer (i.e., plastic), metal, carbon fiber, synthetic material, natural material (such as leather) or other desired material(s).

DETAILED DESCRIPTION OF THE INVENTION

Figure 1:
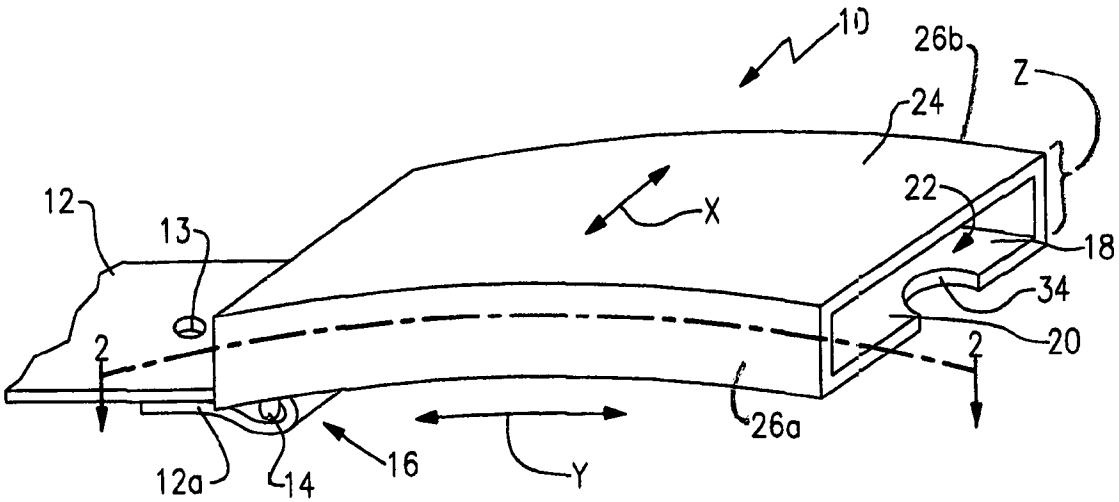
FIG. 1 is a view in perspective of a tapered belt buckle.
Figure 2:
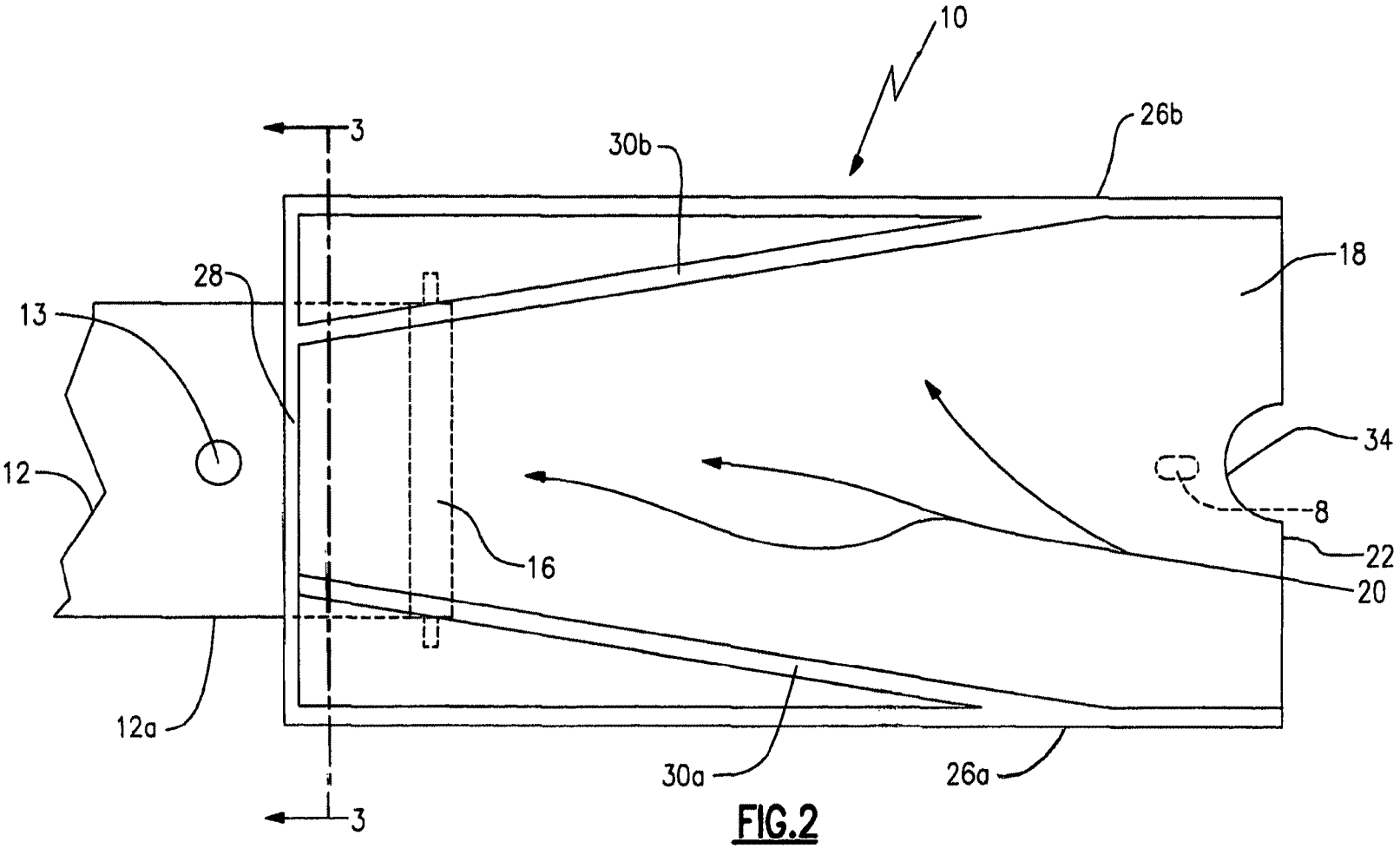
FIG. 2 is a cross-sectional view taken along the line 2-2 of FIG. 1.
Figure 3:
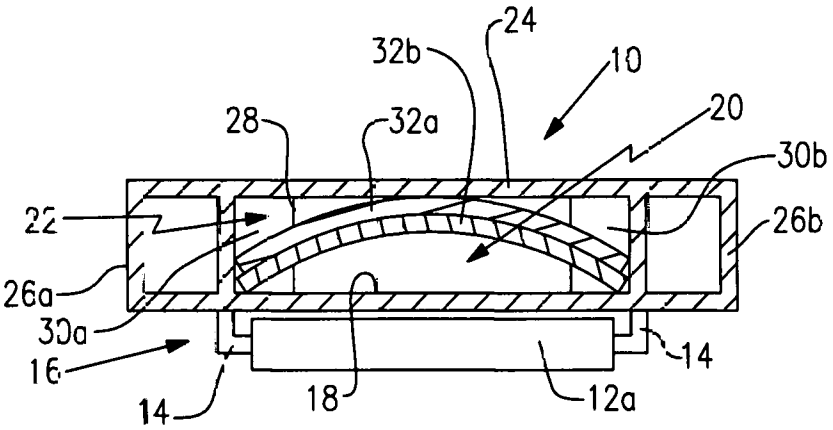
FIG. 3 is a cross-sectional view taken along the line 3-3 of FIG. 2.

Referring to FIG. 1, FIG. 2 and FIG. 3 is shown, a tapered belt buckle, identified in general by the reference numeral 10.

A belt 12 includes a loop end 12*a* that is attached to a loop 14 of a fastener assembly, identified in general by the reference numeral 16 (See also FIG. 3). A tip of the loop end

12*a* of the belt 12 wraps around the loop 14 of the fastener assembly 16 and is typically secured to another portion of the loop end 12*a* of the belt 12 by a snap 13 or other fastener.

The fastener assembly 16 is secured to a bottom of an inner member 18 (See also FIG. 3) by a pair of rivets (not shown) or by any other preferred means such as welding or adhesive or by any other type of fastener. See U.S. Pat. No. 7,748,088 that issued on Jul. 6, 2010 and U.S. Pat. No. 8,490,254 that issued on Jul. 23, 2013, both by the same inventor, of which the content of each, thereof, is included herein by way of reference.

An opposite front belt end (not shown) of the belt 12 includes a plurality of spaced-apart belt openings, as is well known, for adjusting a circumference of the belt 12. A desired belt opening is placed over an inwardly curving hook 8 (shown in dashed lines) that is attached to an underside of the inner member 18 to secure the belt 12 in position.

Figure 4:
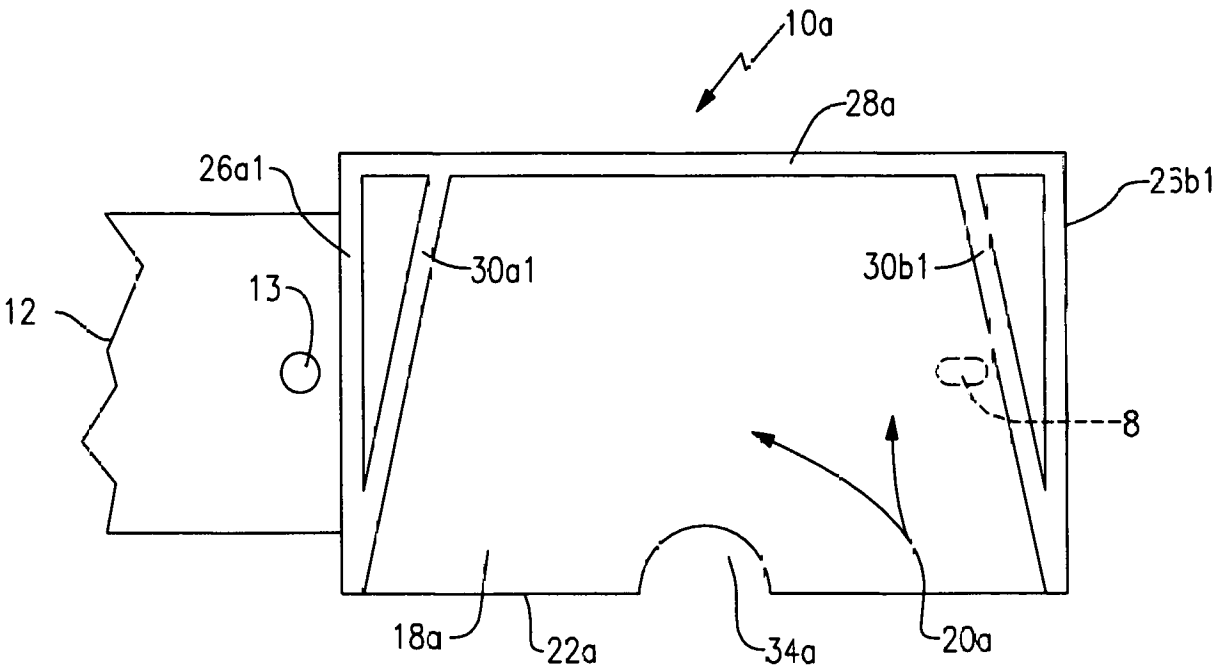
FIG. 4 is a cross-sectional view of a modified bottom opening embodiment that is similar to the view of FIG. 2.

A compartment, identified in general by the reference numeral 20 is included with the tapered belt buckle 10. The compartment 20 includes an opening 22 at a side (FIGS. 1-3) of the compartment 20. If desired, a modified top or bottom opening 22*a* could be disposed at a top or at a bottom of the compartment 20 (FIG. 4).

Referring in particular now to FIG. 1, the tapered belt buckle 10 includes three basic dimensions, a width as identified by arrow X, a length as identified by arrow Y and a thickness as identified by bracket Z. As shown in FIG. 1, the tapered belt buckle 10 includes a slight curvature along the length Y. This is generally preferred as it provides a contour (i.e., a curvature) that better matches the curvature around a wearer's waist. However if desired, the tapered belt buckle 10 could be planar (i.e., straight) along its length Y and also along its width X.

The compartment 20 includes an outer member 24 that is maximally disposed away from a torso (i.e., waist) of a user (not shown) when the tapered belt buckle 10 is worn. The inner member 18 is disposed maximally close to the torso of the user.

A pair of vertical outer sides 26*a*, 26*b* are attached along a bottom edge thereof to a top and an opposing bottom edge of the inner member 18. The vertical outer sides 26*a*, 26*b* are similarly attached along a top edge thereof to a top and an opposing bottom edge of the outer member 24.

Top and bottom edges of a vertical opposite end 28 are similarly attached to the inner and outer members 18, 24 at a distal end of the each of the inner and outer members 18, 24. The distal end of the inner and outer members 18, 24 are disposed maximally away from the opening 22. Opposite ends of the vertical opposite end 28 are attached to distal ends of each of the pair of vertical outer sides 26*a*, 26*b*.

A first of a pair of opposing angled vertical sidewalls 30*a* is attached at a first end, thereof, to a first of the pair of vertical outer sides 26*a*. The first of the pair of opposing angled vertical sidewalls 30*a* is attached at an opposite second end, thereof, to the vertical opposite end 28 at a location that is disposed further away from the first of the pair of vertical outer sides 26*a* than where the first end of the first of the pair of opposing angled vertical sidewalls 30*a* is attached.

A second of the pair of opposing angled vertical sidewalls 30*b* is attached at a first end, thereof, to a second of the pair of vertical outer sides 26*b*. The second of the pair of opposing angled vertical sidewalls 30*b* is attached at an opposite second end, thereof, to the vertical opposite end 28 at a location that is disposed further away from the second of the pair of vertical outer sides 26*b* than where the first end of the second of the pair of opposing angled vertical sidewalls 30*b* is attached.

Accordingly, the width between the first end of the pair of opposing angled vertical sidewalls 30*a*, 30*b* is greater than the width between the second end of the pair of opposing angled vertical sidewalls 30*a*, 30*b*.

The width between the first end of the pair of opposing angled vertical sidewalls 30*a*, 30*b* includes a first width inside the compartment 20 that is equal to or greater than the width of a credit card, driver's license or personal identification card, two of which are shown in FIG. 3 and identified respectively by reference numerals 32*a*, 32*b*.

The width between the second end of the pair of opposing angled vertical sidewalls 30*a*, 30*b* includes a second width inside the compartment 20 that is less than the width of the card(s) 32*a*, 32*b* when the card(s) 32*a*, 32*b* are disposed on a plane (i.e., when the card(s) 32*a*, 32*b* are flat).

As shown the first end of each of the pair of opposing angled vertical sidewalls 30*a*, 30*b* is attached to each of the respective pair of the of vertical outer sides 26*a*, 26*b* at a location that is offset a short distance into an interior of the compartment 20 (i.e., away from the opening 22). However, if desired, the first end of each of the pair of opposing angled vertical sidewalls 30*a*, 30*b* may be attached to each of the respective pair of the vertical outer sides 26*a*, 26*b* at the opening 22.

The pair of opposing angled vertical sidewalls 30*a*, 30*b*, as shown, are linear. Therefore, as the card(s) 32*a*, 32*b* are progressively inserted into the interior of the compartment 20, the pair of opposing angled vertical sidewalls 30*a*, 30*b* progressively apply an increasing force to a pair of forward opposite edges of the card(s) 32*a*, 32*b* in a linear manner that urges the forward opposite edges of the card(s) 32*a*, 32*b* closer together as the card(s) 32*a*, 32*b* is/are progressively inserted into the compartment 20.

This causes a forward portion of the card(s) 32*a*, 32*b* to increasingly bow as the card(s) 32*a*, 32*b* are progressively inserted into the compartment 20. Insertion of the card(s) 32*a*, 32*b* into the compartment 20 feels smooth to the user even as they are increasingly bowing (curving) at their respective forward edges. The card(s) 32*a*, 32*b* are fully inserted into the compartment 20 when the forward edge of any of the card(s) 32*a*, 32*b* abuts (i.e., comes in contact with) an interior surface of the vertical opposite end 28.

When the card(s) 32*a*, 32*b* are fully inserted into the compartment 20, the bow (i.e., curvature) at the forward edge of each of the card(s) 32*a*, 32*b* is greatest, as shown in FIG. 3. The interior dimensions of the compartment 20 ensure that sufficient space is available to the card(s) 32*a*, 32*b* to bow based on the maximum number of card(s) 32*a*, 32*b* the compartment 20 is intended to house. The maximum number of card(s) 32*a*, 32*b* the tapered belt buckle 10 can securely retain inside the compartment 20 is a design variable.

Friction between the forward edges of the card(s) 32*a*, 32*b* and interior surfaces of the pair of opposing angled vertical sidewalls 30*a*, 30*b* secures the card(s) 32*a*, 32*b* in position in the compartment 20. It is possible, though generally not desired, for a forward top center surface of the uppermost card 32*a* to lightly touch an interior surface of the outer member 24. This is easily avoided by controlling the dimensions of the components that define an active area of the compartment 20, as is described in greater detail below. Preferably, contact with the card(s) 32*a*, 32*b* only occurs along a portion of the edges of the card(s) 32*a*, 32*b* to prevent damage from occurring to a magnetic strip that may be present on certain types of the card(s) 32*a*, 32*b*.

If desired, the pair of opposing angled vertical sidewalls 30*a*, 30*b* may include a curvature. If a curvature is included in the pair of opposing angled vertical sidewalls 30*a*, 30*b* then a non-linear increase in a rate of bowing of the forward edge of the card(s) 32*a*, 32*b* will occur as the card(s) 32*a*, 32*b* are inserted into the compartment 20. Insertion of the card(s) 32*a*, 32*b* into the compartment 20 will still feel smooth to the user as no sudden bumps or obstacles would be encountered, however, the force necessary for insertion may vary in a non-linear manner if the pair of opposing angled vertical sidewalls 30*a*, 30*b* includes the curvature.

Insertion of the card(s) 32*a*, 32*b* into or out of the compartment 20 is accomplished by inserting a width (i.e., the narrow side) of the card(s) 32*a*, 32*b* into the compartment 20 until the forward edge of each of the card(s) 32*a*, 32*b* makes contact with the interior surface of the vertical opposite end 28. The motion to insert or remove the card(s) 32*a*, 32*b* occurs horizontally, generally parallel with respect to a ground surface. This can be accomplished while the belt 12 is fastened or, if preferred, the belt 12 can be loosened for insertion or removal of the card(s) 32*a*, 32*b*.

The active portion of the compartment 20 in which the card(s) 32*a*, 32*b* are contained is defined by the inner member 18 on the bottom, the upper member 24 on the top, the opposing angled vertical sidewalls 30*a*, 30*b* which impinge on the longer sides of the card(s) 32*a*, 32*b* and the vertical opposite end 28 which limits the horizontal insertion depth of the card(s) 32*a*, 32*b*.

The tapered belt buckle 10 is able to securely house one or more of the card(s) 32*a*, 32*b* in the compartment 20. This allows certain users to avoid having to carry a wallet or a purse, yet the essential forms of identification and access to funds provided by credit and/or debit cards 32*a*, 32*b* are being carried about on their person, not visible to others, safe and secure.

A recess 34 is preferably included through the inner member 18 proximate the opening 22 to facilitate grasping of an outer portion of the card(s) 32*a*, 32*b* when it is desirable to remove them from the compartment 20. The card(s) 32*a*, 32*b* may be inserted and/or removed individually or together as a group, as desired.

As shown outer member 24, the inner member 18, the pair of vertical outer sides 26*a*, 26*b*, and the pair of opposing angled vertical sidewalls 30*a*, 30*b* are all curved along the length Y. However, if desired, the inner member 18 and a bottom edge of the pair of vertical outer sides 26*a*, 26*b* and a bottom edge of the pair of opposing angled vertical sidewalls 30*a*, 30*b* could include a curvature along the length Y while the top edges thereof could be straight (on a plane) along with the outer member 24. If this were accomplished an interior of the tapered belt buckle 10 would include the curvature (along the torso or waist) while the outer member 24 and, therefore the front surface, would be disposed on a plane which would provide an alternate aesthetic appearance for the tapered belt buckle 10.

Referring now to FIG. 4 is shown a modified tapered belt buckle, identified in general by the reference numeral 10*a*. The modified tapered belt buckle 10*a* is similar to the tapered belt buckle 10 except that it includes the modified opening 22*a* disposed at a bottom of the modified tapered belt buckle 10*a*. If desired, the modified opening 22*a* could be disposed at a top of the modified tapered belt buckle 10*a*.

For the modified tapered belt buckle 10*a* the motion to insert or remove the card(s) 32*a*, 32*b* includes vertically raising the card(s) 32*a*, 32*b* into a modified compartment 20*a*. Friction similarly retains the card(s) 32*a*, 32*b* in a modified compartment, identified in general by the reference numeral 20*a*, of the modified tapered belt buckle 10*a*.

A longer modified vertical opposite end 28*a* extends along the length of the modified tapered belt buckle 10*a*. A shorter pair of modified vertical outer sides 26*a*1, 26*b*1 are disposed at the exterior sides of the modified tapered belt buckle 10*a*. A shorter pair of modified opposing angled vertical sidewalls 30*a*1, 30*b*1 are provided in the modified compartment 20*a* area.

The active portion of the modified compartment 20*a* in which the card(s) 32*a*, 32*b* are contained is defined by the a modified inner member 18*a* on the bottom, a modified upper member (not shown) on the top, the modified opposing angled vertical sidewalls 30*a*1, 30*b*1 which impinge on the shorter sides of the card(s) 32*a*, 32*b* and the modified vertical opposite end 28*a* which limits the upward (when the modified opening 22*a* is disposed at the bottom) insertion depth of the card(s) 32*a*, 32*b*. The modified opposing angled vertical sidewalls 30*a*1, 30*b*1 cause the bow in the card(s) 32*a*, 32*b* to occur along the longitudinal length of the cards(s) 32*a*, 32*b* rather than across the width of the cards(s) 32*a*, 32*b*, as occurs with the tapered belt buckle 10. A modified recess 34*a* is optionally included in the modified inner member 18*a* to facilitate grasping of the outer portion of the card(s) 32*a*, 32*b* when it is desirable to remove them from the modified compartment 20*a*.

The tapered belt buckle 10 or the modified tapered belt buckle 10*a* provide concealed carrying of the card(s) 32*a*, 32*b* without the use of any spring or other member that bears down on any flat portion of the card(s) 32*a*, 32*b*. This prevents damage from occurring to the magnetic strip (not shown) present on certain types of the card(s) 32*a*, 32*b*.

Other means to force the card(s) 32*a*, 32*b* to bow are possible after having had benefit of the present disclosure. For example, a further modified upper member (not shown) that includes a progressively increasing curvature on an interior surface, thereof, could be used to cause the card(s) 32*a*, 32*b* to increasingly bow in a downward direction as they are progressively urged into a further modified compartment (not shown).

Similarly, a further modified lower member (not shown) that includes a progressively increasing curvature on an interior surface, thereof, could be used to cause the card(s) 32*a*, 32*b* to increasingly bow in an upward direction as they are progressively urged into a still further modified compartment (not shown).

The two preceding alternate embodiments illustrate other means for bending the card(s) 32*a*, 32*b* and the use of friction for retaining the card(s) 32*a*, 32*b* within the tapered belt buckle 10 or the modified tapered belt buckle 10*a*. However, an alternate embodiment that applies pressure to a surface of the card(s) 32*a*, 32*b* is not generally preferred as certain of the card(s) 32*a*, 32*b* may include a magnetic strip or indicia or an image that could be damaged by such pressure.

The tapered belt buckle 10 or the modified tapered belt buckle 10*a* can be formed of any desired material or combination of materials, including a desired polymer (i.e., plastic), metal, carbon fiber, synthetic material, natural material (such as leather) or other desired material. For example, the tapered belt buckle 10 or the modified tapered belt buckle 10*a* could be formed of plastic using a two-piece mold along the length Y axis (or otherwise, as desired) and assembled together.

Any embodiment of the tapered belt buckle 10 can include as few or as many component parts as desired.

Similarly, the tapered belt buckle 10 or the modified tapered belt buckle 10*a* can be formed of cast, stamped, welded, or adhered metals. If desired, the tapered belt buckle 10 or the modified tapered belt buckle 10*a* could be formed of any desired material, synthetic or natural, by any preferred manufacturing method.

For example, the tapered belt buckle 10 or the modified tapered belt buckle 10*a* could be formed entirely of leather. Alternately, the tapered belt buckle 10 or the modified tapered belt buckle 10*a* could be formed of a combination of materials such as a cast metal shell with a plastic insert.

If desired, the tapered belt buckle 10 or the modified tapered belt buckle 10*a* can include a leather wrap-around covering or, if desired, a leather faceplate could be adhered to an exterior surface of the upper member 24 (or the modified upper member 24*a*) for ornamentation. If desired, the upper member 24 (or the modified upper member 24*a*) could include a cast, engraved or molded sculpture.

If desired, ornamental objects or precious metals, minerals, stones or jewels could be added to the upper member 24 (or the modified upper member 24*a*) in order to provide any desired ornamental appearance.

The tapered belt buckle 10 or the modified tapered belt buckle 10*a*, as shown, when viewed from the front have a generally rectangular appearance. It is important to note that it is also possible to include a desired radius at the corners or to modify or otherwise change the overall shape and appearance as desired to include, for example, an oval or even circular appearance while continuing to ensure that the compartment 20 (or the modified compartment 20*a*) includes a size that is able to house as much of the card(s) 32*a*, 32*b* as desired.

The invention has been shown, described, and illustrated in substantial detail with reference to the presently preferred embodiment. It will be understood by those skilled in this art that other and further changes and modifications may be made without departing from the spirit and scope of the invention which is defined by the claims appended hereto.

What is claimed is:

1. A tapered belt buckle for use in fastening a belt by a user and which is also able to detachably secure a credit card or a driver's license card or a personal identification card or a similarly sized card thereto, comprising:

(a) an outer member that includes an exterior surface and an opposite interior surface;

(b) an inner member to be disposed a predetermined distance away from said outer member, said inner member for being disposed proximate a waist of the user during use;

(c) a compartment that is disposed between said outer member and said inner member, wherein said compartment includes an opening at one end, thereof, and a pair of opposing angled vertical sidewalls that include a first width between a first end of each of said pair of opposing angled vertical sidewalls and wherein said first end of each of said pair of opposing angled vertical sidewalls is disposed proximate said opening and a second width between an opposite second end of each of said pair of opposing angled vertical sidewalls and wherein said second end of each of said pair of opposing angled vertical sidewalls is disposed distally away from said first end and distally away from said opening, wherein said first width is greater than said second width, and wherein said first width is equal to or greater than a width or a length of the credit card or the driver's license or the personal identification card or the similarly sized card, and wherein said second width is less than said width or said length of the credit card or the driver's license or the personal identification card or the similarly sized card;

wherein when the credit card or the driver's license or the personal identification card or the similarly sized card is progressively inserted into said compartment a portion of the credit card or the driver's license or the personal identification card or the similarly sized card is progressively forced to bow to accommodate a narrowing distance between said pair of opposing angled vertical sidewalls, and wherein friction between the credit card or the driver's license or the personal identification card or the similarly sized card and said pair of opposing angled vertical sidewalls is sufficient to retain the credit card or the driver's license or the personal identification card or the similarly sized card in said compartment;

(d) a vertical opposite end member disposed maximally away from said opening, said vertical opposite end member disposed between said pair of opposing angled vertical sidewalls; and (e) means for attaching a first end of the belt to the tapered belt buckle and means for attaching an opposite second end of the belt to the tapered belt buckle.

2. The tapered belt buckle of claim 1 wherein a forward portion of any one of the cards is progressively forced to bow to accommodate said narrowing distance between said pair of opposing angled vertical sidewalls as the one card is increasingly urged into said compartment.

3. The tapered belt buckle of claim 1 wherein an active area of said compartment for containment of any one of the cards is defined by the inner member on a bottom, said outer member on a top, said pair of opposing angled vertical sidewalls which impinge on opposite sides of the one card and said vertical opposite end member.

4. The tapered belt buckle of claim 1 wherein said means for attaching a first end of the belt to the tapered belt buckle includes a fastener assembly that is attached to said inner member, and wherein said fastener assembly is adapted to secure a loop end of the belt, thereto.

5. The tapered belt buckle of claim 1 wherein said means for attaching a second end of the belt to the tapered belt buckle includes a hook attached to said inner member.

6. The tapered belt buckle of claim 5 wherein said hook includes an inwardly curving hook.

7. The tapered belt buckle of claim 1 wherein said opening is disposed at a left side or at a right side of the tapered belt buckle.

8. The tapered belt buckle of claim 1 wherein said opening is disposed at a top or at a bottom of the tapered belt buckle.

9. The tapered belt buckle of claim 1 including a pair of vertical outer sides that are each disposed along one of a pair of outer edges of the tapered belt buckle, wherein each of said pair of vertical outer sides provide a finished exterior appearance of the tapered belt buckle, and wherein each of said pair of vertical outer sides obscure visibility of at least a portion of one of said pair of opposing angled vertical sidewalls from an exterior of the tapered belt buckle.

10. A tapered belt buckle for use in fastening a belt by a user and which is also able to detachably secure a credit card or a driver's license or a personal identification card or a similarly sized card thereto, comprising:

(a) an outer member that includes an exterior surface and an opposite interior surface;

(b) an inner member to be disposed a predetermined distance away from said outer member, said inner member for being disposed proximate a waist of the user during use;

(c) a compartment that is disposed between said outer member and said inner member, wherein said compartment includes an opening at one end, thereof;

(d) means for progressively bending or curving a portion of the credit card or the driver's license or the personal identification card or the similarly sized card when the credit card or the driver's license or the personal identification card or the similarly sized card is progressively inserted into said compartment, wherein said means for progressively bending or curving a portion of the credit card or the driver's license or the personal identification card or the similarly sized card includes said compartment and wherein said compartment includes a pair of opposing angled vertical sidewalls that impinge upon opposite edges of a leading edge of the credit card or the driver's license or the personal identification card or the similarly sized card as the credit card or the driver's license or the personal identification card or the similarly sized card is progressively inserted into said compartment, and wherein said pair of opposing angled vertical sidewalls progressively bow said leading edge of the credit card or the driver's license or the personal identification card or the similarly sized card as the credit card or the driver's license or the personal identification card or the similarly sized card is progressively urged into said compartment, and wherein a direction of said bow is perpendicular with respect to a direction that the credit card or the driver's license or the personal identification card or the similarly sized card is urged into said compartment, and wherein friction between the credit card or the driver's license or the personal identification card or the similarly sized card and an interior of the compartment is sufficient to retain the credit card or the driver's license or the personal identification card or the similarly sized card in said compartment; and (e) means for attaching a first end of the belt to the tapered belt buckle and an opposite second end of the belt to the tapered belt buckle.

* * * * *